United States Patent [19]

Mueller et al.

[11] Patent Number: 4,944,500

[45] Date of Patent: Jul. 31, 1990

[54] TRANSLATION LOCK FOR SURGICAL TABLE WITH DISPLACEABLE TABLETOP

[75] Inventors: Wolfgang Mueller; Arthur T. Nagare, both of Erie, Pa.

[73] Assignee: American Sterilizer Company, Erie, Pa.

[21] Appl. No.: 35,529

[22] Filed: Apr. 7, 1987

[51] Int. Cl.[5] ..... A61G 13/00

[52] U.S. Cl. ..... 269/322

[58] Field of Search ..... 269/322–328; 292/144

[56] References Cited

U.S. PATENT DOCUMENTS

| | | | |
|---|---|---|---|
| 3,588,500 | 6/1971 | Koerner | 269/323 |
| 3,609,357 | 4/1971 | William | 269/323 |
| 3,765,709 | 10/1973 | Van Wyck | 292/144 |
| 3,947,060 | 3/1976 | Zimmer et al. | 292/144 |
| 4,230,350 | 10/1980 | Gee et al. | 292/144 |

*Primary Examiner*—Judy Hartman

*Attorney, Agent, or Firm*—Kirkpatrick & Lockhart

[57] ABSTRACT

An apparatus is disclosed for preventing the undesired movement of the tabletop of a surgical table. The table is provided with a superstructure which supports a carriage assembly having lateral and longitudinal channels supported by rollers. A first rotary electric solenoid is mounted on the table superstructure and actuates by linkages a first locking shaft to lock the lateral carriage to the table superstructure. A second rotary electric solenoid is mounted on the lateral carriage and is connected by linkages to a second locking shaft to lock the longitudinal carriage to the lateral carriage. When the rotary solenoids are activated, their respective locking shafts are retracted thereby enabling horizontal translation of the tabletop.

6 Claims, 6 Drawing Sheets

TRANSLATION LOCK FOR SURGICAL TABLE WITH DISPLACEABLE TABLETOP

BACKGROUND OF THE INVENTION

Reference is made to the following United States patent applications which were filed on the same date as the present application, are owned by the assignee of the present application and relate to inventions which are employed on the same commercial apparatus of this invention: Ser. No. 035,674, filed Apr. 7, 1987, now U.S. Pat. No. 4,761,100, issued Aug. 2, 1988 and Ser. No. 035,675, filed Apr. 7, 1987, now U.S. Pat. No. 4,778,164, issued Oct. 18, 1988.

1. Field of the Invention

The present invention relates to surgical tables and, in particular, to means for preventing the horizontal displacement of an otherwise horizontally movable tabletop of a surgical table.

2. Description of the Invention Background

Conventional hospital operations often require the use of a table which may support a patient during the performance of various radiological operations. Such tables typically include a base member from which extends an upstanding support member to support a table superstructure The table superstructure, in turn, supports a carriage assembly attached to the underside of the tabletop and which allows the tabletop to be translated both laterally of the longitudinal axis of the table and along that axis.

Conventional radiographic tables include means for preventing the undesired horizontal displacement of the tabletop. Such tables typically include magnetically operated brakes which engage the moving parts of the carriage assembly to prevent the displacement thereof.

However, it has become apparent to Applicants that typical magnetic brake installations are often insufficient to completely prevent table displacement. This problem is particularly apparent in connection with a table which has been developed which, in addition to allowing the horizontal displacement of the tabletop, allows the table superstructure to be tilted to the right or left of its center line or tilted about its lateral axis. Applicants have realized that in order to maintain a table top in a stable position during such tilting operations, a positive locking mechanism is required.

The subject invention is directed toward a table for medical use which includes a horizontally displaceable tabletop and a means for positively mechanically locking the tabletop to the table superstructure to prevent undesired movements thereof.

SUMMARY OF THE INVENTION

In accordance with the present invention, there is provided a table for medical use which includes a tabletop which may be horizontally displaced and also mechanically locked to the table superstructure. In particular, the table includes a base member having an upstanding support column and a vertical hydraulic cylinder which supports the table superstructure for raising and lowering. Such superstructure is capable of being raised and lowered relative to the column and of being tilted to the right and left of center line and tilted about a lateral axis.

Carriage means support the tabletop on the superstructure for free floating movement relative thereto under manual control. In addition, there are provided means for preventing the displacement of the tabletop in the lateral direction (X direction) and in the longitudinal direction (Y direction). In particular, a first rotary electric solenoid is mounted on a bracket supported by the table superstructure and is connected by means of linkages to a vertical first locking shaft. The locking shaft, when extended, may engage a receptacle area of a downwardly extending plate attached to the lower side of the carriage assembly. Spring means are provided to normally extend the locking shaft upwardly. The rotary solenoid may then be employed to retract the locking shaft from the receptacle area to allow the movement in the lateral direction of the tabletop.

In addition, means are provided for locking the tabletop against movement in the longitudinal direction. A second rotary electric solenoid is mounted within the carriage assembly and is pivotally attached by means of linkages to a horizontal second locking shaft. The second locking shaft is provided on its end with a roller which is normally spring-biased to an extended position. However, a notched area is provided on a corresponding channel of the carriage assembly such that when the roller enters the notched area, the respective channels are locked thereby preventing movement of the tabletop in the longitudinal direction. When movement is desired, the second solenoid may be energized to retract the second locking shaft and, hence, allow longitudinal displacement.

Accordingly, the present invention provides a positive mechanical lock of a tabletop of a surgical table which has been heretofore unavailable. As the present invention provides, a positive mechanical lock, the uncertain locking provided by magnetic brakes is avoided. In addition, the present invention provides a positive lock so that the tabletop may also be tilted laterally or longitudinally relative to the table superstructure.

These and other details, objects and advantages of the invention will become apparent as the following description of the present preferred embodiment thereof proceeds.

BRIEF DESCRIPTION OF THE DRAWINGS

In the accompanying drawings there is shown a present preferred embodiment of the invention wherein.

DETAILED DESCRIPTION OF THE PREFERRED EMBODIMENT

Figure 1:
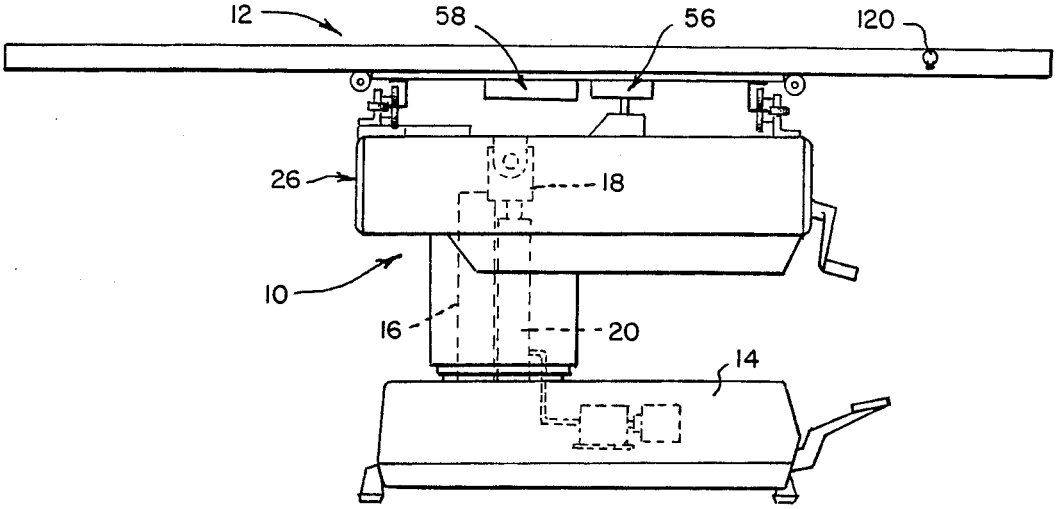
FIG. 1 is a side elevation view of a surgical table which includes the present invention.
Figure 10:
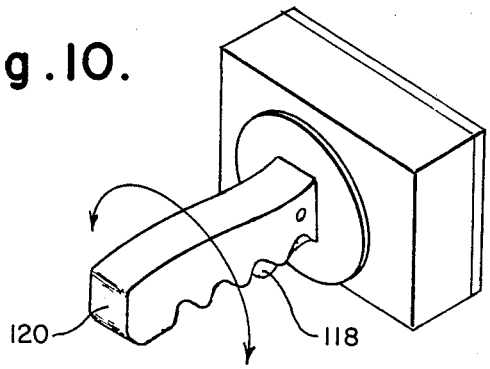
FIG. 10 is a view of the switch control for the locking mechanism.
Figure 2:
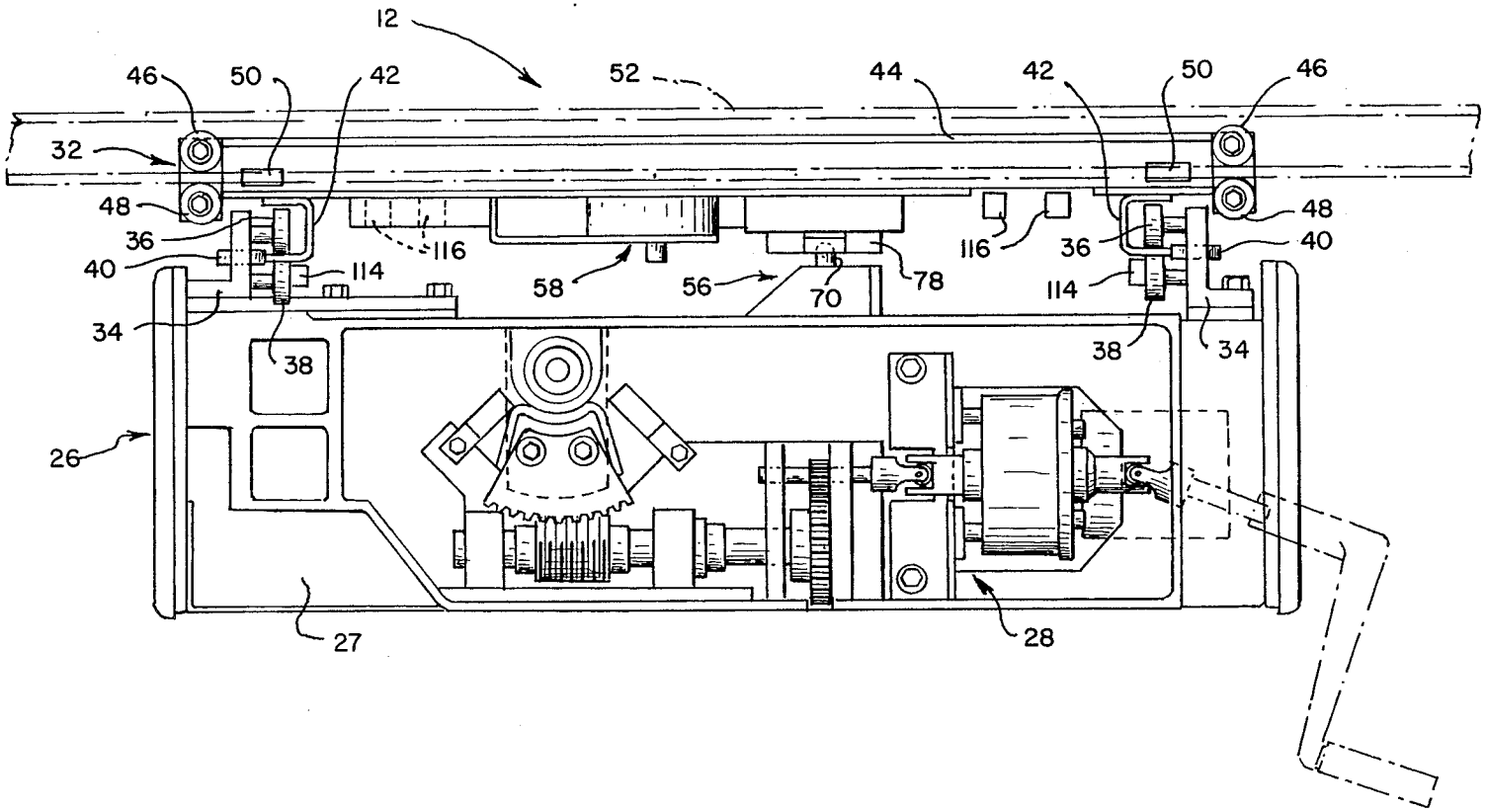
FIG. 2 is a left side elevation view of the table superstructure and carriage assembly.
Figure 3:
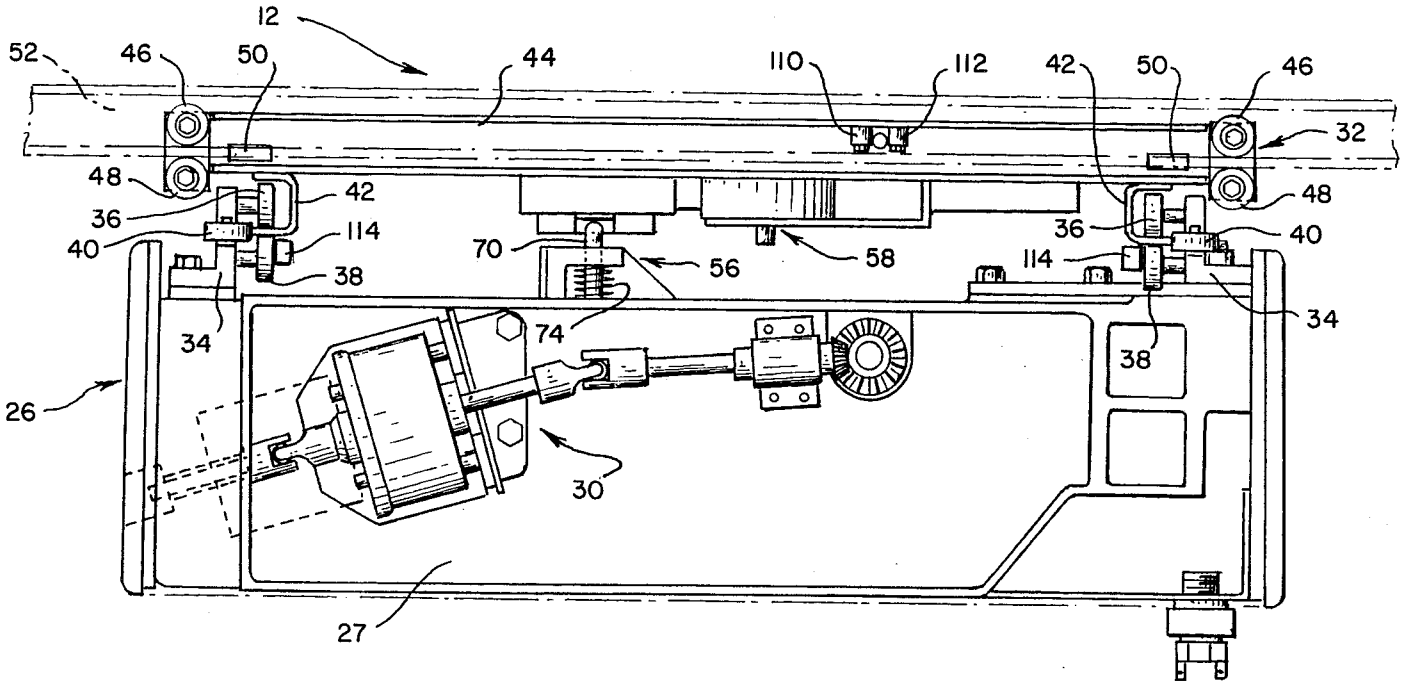
FIG. 3 is a right side elevation view of the table superstructure and carriage assembly.
Figure 4:
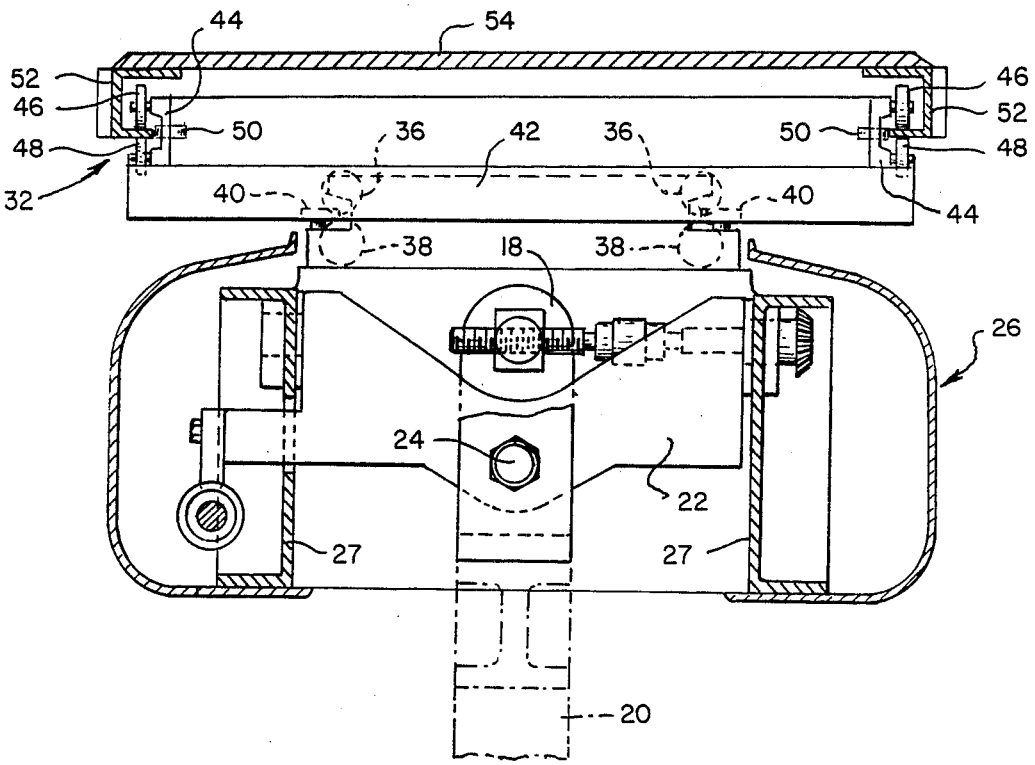
FIG. 4 is a lateral sectional view of the table superstructure and carriage assembly.
Figure 5:
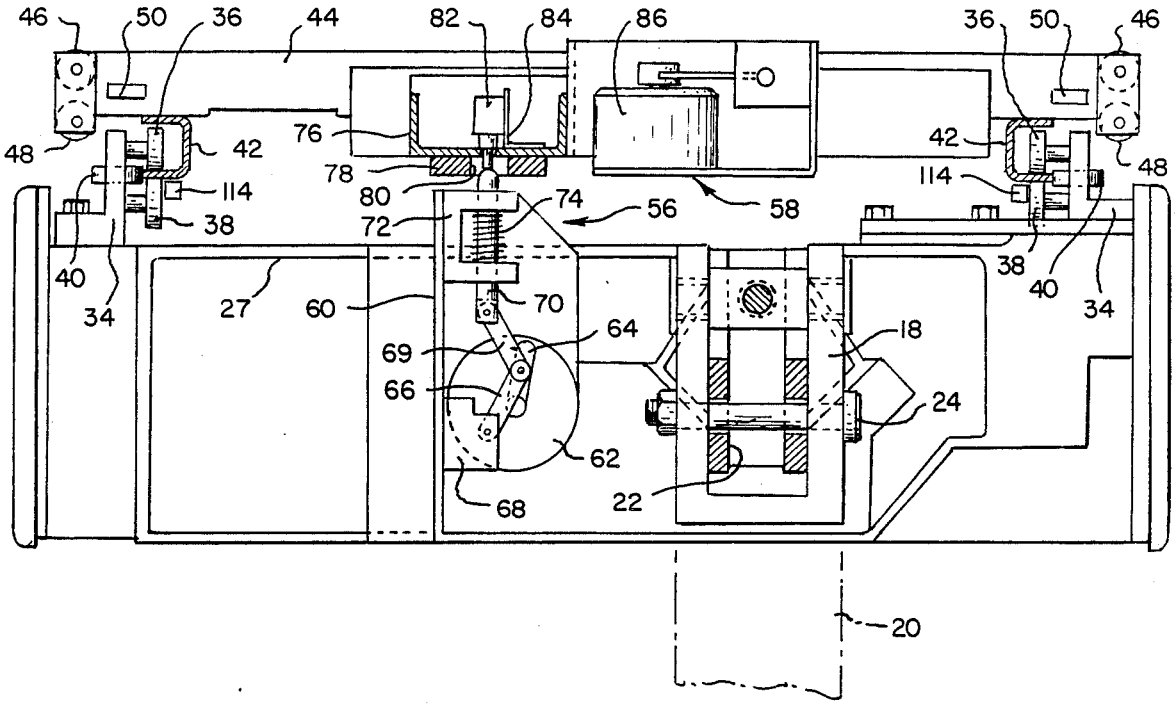
FIG. 5 is a side elevation sectional view showing the lateral locking mechanism of the present invention.
Figure 6:
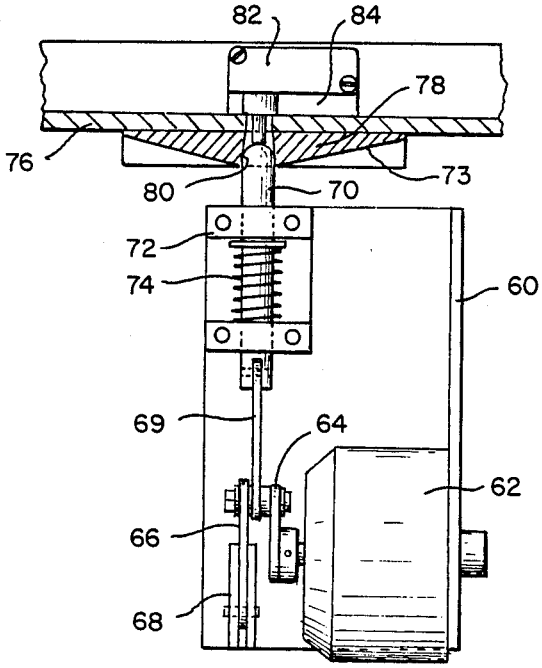
FIG. 6 is a detailed end elevation view of the lateral locking mechanism according to the present invention.
Figure 7:
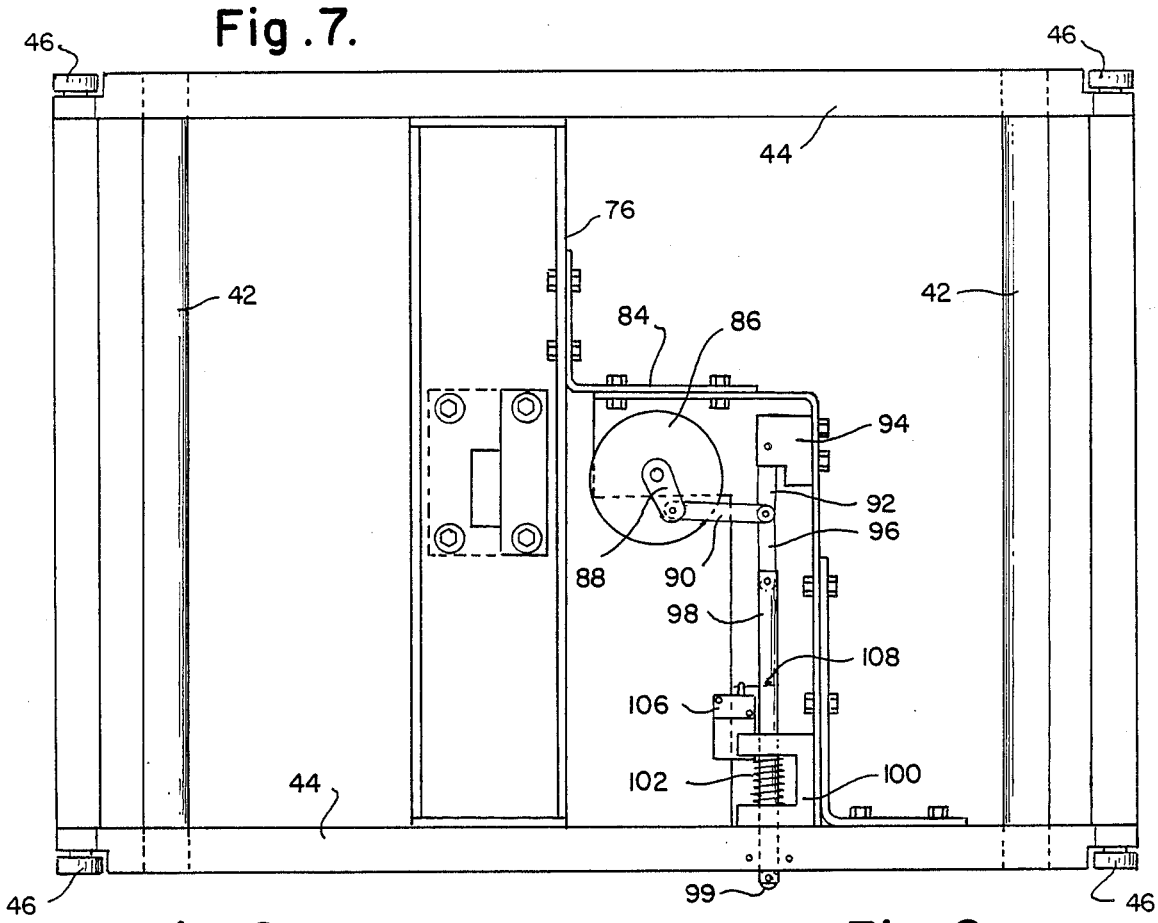
FIG. 7 is a plan view of the longitudinal locking mechanism.
Figure 8:
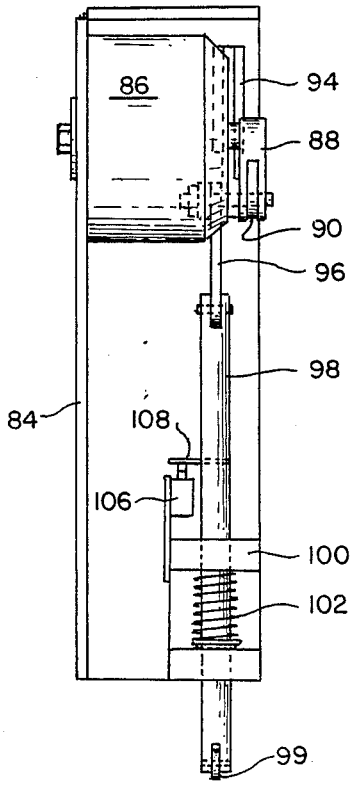
FIG. 8 is an end elevation view of the longitudinal locking mechanism.
Figure 9:
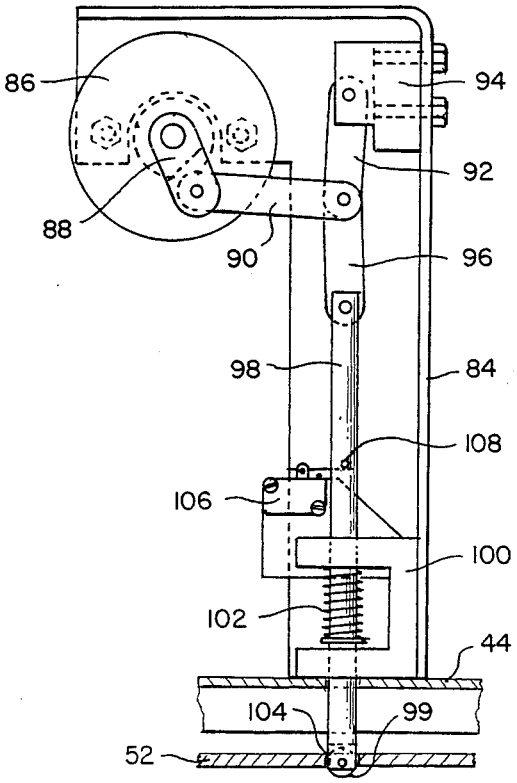
FIG. 9 is a more detailed plan view of the longitudinal locking mechanism.

Referring now to the drawings wherein the showings are for purposes of illustrating the present preferred embodiment of the invention only and not for purposes of limiting same, the Figures show a surgical table 10 having a top assembly 12 which may be horizontally displaced. As used herein, the front or head end of table 10 will be that end on the right as viewed in FIG. 1.

More particularly and with reference to FIG. 1, there is shown a surgical table having a base member 14 from which upwardly extends a column 16. Column 16 provides a guide rail for a yoke 18 which may be raised and lowered by means of hydraulic cylinder 20 in a manner known to those skilled in the art.

A saddle member 22 is pivotally attached to yoke 18 by means of a pin 24. A table superstructure assembly, generally indicated as 26, is pivotally supported on the saddle member 22 by means which are also known in the art. As such, the raising and lowering of yoke 18 causes corresponding movement of superstructure 26. Table superstructure 26 includes a surrounding frame 27. In addition, means are provided to tilt the superstructure 26 relative to the yoke 18 along both the longitudinal and lateral axis. A longitudinal tilting mechanism, generally indicated as 28, serves in a manner known to those skilled in the art to, under power or manually, translate the table superstructure 26 about a lateral axis so that one end or the other of the tabletop may be raised or lowered. In addition, lateral tilting means, generally indicated as 30, serve, under power or manually, to tilt the superstructure 26 about its longitudinal axis in a manner also known to those skilled in the art. The operating mode of table 10 in which lateral and longitudinal tilting are possible is referred to as its surgical mode.

A carriage assembly 32 is supported by the frame 27 of the superstructure 26 so as to allow the top assembly 12 to be horizontally displaced either parallel to its longitudinal axis or transverse thereto. The mode of operation of table 10 for horizontal translation of top assembly 12 is the translation mode. Brackets 34 are provided on the fore and aft lateral cross-members of frame 27 and each support a grouping of three rollers to guide the lateral translation of top assembly 12. The brackets 34 support an upper roller 36, a lower roller 38 and a transverse roller 40. Lateral C-shaped channels 42 are supported between upper rollers 36, lower rollers 38 and transverse rollers 40. It is the movement of lateral channels 42 within such rollers which allows the lateral translation of the top assembly 12.

Secured to the upper sides of lateral channels 42 are first longitudinal channels 44. Longitudinal channels 44 support at their fore and aft ends upper guide rollers 46, lower guide rollers 48 and transverse rollers 50. Upper longitudinal channels 52 are provided on the right and left sides of top assembly 12 and are supported by upper rollers 46, lower rollers 48 and transverse rollers 50. A radioluscent table surface 54 is attached to the upper sides of upper longitudinal channels 52. Accordingly, table assembly 12 may be displaced along its longitudinal axis by the passage of upper longitudinal channels 52 between upper rollers 46, lower rollers 48 and transverse rollers 50.

In order to prevent the undesired horizontal displacement of top assembly 12 relative to superstructure 26, there is provided a lateral or X direction translation lock assembly, generally designated as 56, and a longitudinal or Y direction translation lock assembly, generally 58. Lateral translation lock assembly 56 includes a bracket 60 which is secured to frame 27 of superstructure 26. Bracket 60 supports a first rotary electric solenoid 62. First solenoid 62 provides a rotary output to a first link 64. Link 64 is pivotally attached to a second link 66 which is pivotally attached at its other end to a block 68 secured on bracket 60. First link 64 and second link 66 are pivotally attached to a transmitting link 69 which is attached to the lower end of a vertical locking shaft 70. Locking shaft 70 is supported by means of a trunnion 72 mounted on bracket 60. A spring 74 mounted on trunnion 72 serves to normally bias the locking shaft 70 to an upwardly extended position. It is the action of first electric solenoid 62 coupled the links 64, 66 and 69 which retracts locking shaft 70 against the action of spring 74.

Mounted to the lower surfaces of longitudinal channels 44 is a bracket 76 which supports a downwardly extending receptacle plate 78 which is provided with a recessed receptacle area 80. Receptacle area 80 is laterally ramped so that when first solenoid 62 is not activated and, hence, locking shaft 70 is extended, if receptacle plate 78 is passed over locking shaft 70, locking shaft 70 may enter receptacle area 80 so as to positively lock the carriage assembly 32 against lateral movement. A limit switch 82 has a probe which extends into receptacle area 80 so that it is contacted when locking shaft 70 is disposed within receptacle area 80 to generate a signal indicative of such condition.

In order to prevent the undesired movement of carriage 32 in the longitudinal direction, a bracket 84 is affixed between bracket 76 and one of the longitudinal channels 44 and supports a second rotary electric solenoid 86. Second solenoid 86 provides a rotational output to pivot a third link 88. Third link 88 is pivotally attached to an intermediate link 90 whose end is pivotally attached to a fourth link 92. The other end of fourth link 92 is pivotally attached to a block 94 mounted on bracket 84. Intermediate link 90 and fourth link 92 are also pivotally attached to a transmitting link 96. Transmitting link 96 is pivotally attached to the end of a locking shaft 98 which has a roller 99 attached to the other end thereof. Locking shaft 98 is supported by means of trunnion 100 attached to bracket 84. A spring 102 is connected intermediate trunnion 100 and locking shaft 98 so as to urge locking shaft 98 to its extended position.

Locking shaft 98 extends through longitudinal channel 44 and into a notch 104 in upper longitudinal channel 52. Accordingly, the extension of locking shaft 98 into notch 104 locks upper longitudinal channel 52 to longitudinal channel 44 to prevent the longitudinal translation of table surface 54. A limit switch 106 is also mounted on bracket 84 and includes an arm which may be engaged by a lug 108 on locking shaft 98 to indicate that the locking shaft 98 is extended and to generate a corresponding indicating signal. It is additionally notable that when locking shaft 98 is retracted by means of second electric solenoid 86, roller 99 may ride on the inner surface of upper longitudinal channel 52. However, when roller 99 encounters notch 104 it drops into notch 104 and hence locks the carriage 32 from longitudinal movement.

In order to assure the alignment of locking shaft 98 with notch 104, eccentric guide rollers 110 and 112 are provided on longitudinal channel 44. By adjusting the relative positions of eccentric guide rollers 110 and 112, respectively, locking shaft 98 may be properly aligned with notch 104 when the carriage 32 is in its home position, that is, the position in which roller 99 is in notch 104 and locking shaft 90 in recessed area 80.

Applicants have discovered that the linkages connected between first solenoid 62 and locking shaft 70 and between second solenoid 86 and locking shaft 98 provide a mechanical advantage to retract those shafts even though a transverse load may be applied thereto, such as if a person were leaning against top assembly 12.

As will be explained in detail below, during certain phases of the operation of table 10, the X lock assembly 56 and the Y lock assembly 58 may be deactivated. At such times, it may be necessary to maintain the top assembly 12 in a fixed location. Accordingly, dual sets of first electric solenoid controlled magnetic brakes 114 are provided on fore and aft brackets 34 in facing relation to transverse channels 42 to lock transverse channels 42 to brackets 34 and, hence, prevent lateral displacement of top assembly 12. In addition, dual sets of second electric solenoid controlled magnetic brakes 116 are provided at fore and aft locations on longitudinal channels 44 and in facing relation to upper longitudinal channels 52 to lock upper longitudinal channels 52 to longitudinal channels 42 to prevent longitudinal movement of top assembly 12. The energization of magnetic brakes 114 and 116 to lock channels 52, respectively, is controlled by a trigger switch 118 mounted on a handle switch 120 supported on top assembly 12.

It will be appreciated that magnetic brakes 114 and 116 are not capable of generating the positive mechanical locking produced by X lock assembly 56 and Y lock assembly 58. For example, magnetic brakes 114 and 116 are insufficient to hold top assembly 12 stable if lateral tilt mechanism 30 and/or longitudinal tilt mechanism 28 are used to move top assembly 12.

In addition to the foregoing, the present invention comprises electrical circuitry connected between a source of electric power and between handle switch 120 and first solenoid 62 and second solenoid 86 and between trigger switch 118 and first solenoid 62 and magnetic brakes 114 and 116, respectively, to allow the following operation of table 10. When electrical power is initially supplied to table 10, handle switch 120 and trigger switch 118 are energized. When handle switch 120 is activated by a user, first solenoid 62 retracts first locking shaft 70 from its locked position and second solenoid 86 retracts second locking shaft 98 from its locked position. However, the actuation of trigger switch 118 is also required to disengage magnetic brakes 114 and 116. The top assembly 12 is then displaced along its longitudinal axis so that roller 99 is longitudinally remote from notch 104. When roller 99 is longitudinally remote from notch 104, locking shaft 98 is, of course, not in its fully extended position, a condition which is sensed by limit switch 106. When limit switch 106 indicates that locking shaft 98 is not extended, the electrical control circuitry allows first solenoid 62 to be controlled by trigger switch 118. Therefore, when the top assembly 12 has been initially longitudinally displaced, to further move top assembly, trigger switch 118 is actuated which disengages magnetic brakes 114 and 116 and also causes first solenoid 62 to retract locking shaft 72. The actuation of first solenoid 62 by trigger switch 118 is necessary because if it was not actuated, if top assembly 12 was in its lateral home position, locking shaft 72 would prevent its movement and if top assembly 12 was not in its lateral home position and top assembly 12 was moved laterally over the home position, locking shaft 72 would enter receptacle area 80 to cause the abrupt cessation of lateral movement.

In the event top assembly 12 was desired to be returned to its home position to cause the locking of X lock assembly 56 and Y lock assembly 58 to enable other operations of table 10, the trigger switch 118 must be actuated and the top assembly 12 moved to its longitudinal home position. Once that position is reached, roller 99 will enter notch 104 and limit switch 106 will generate a signal to the electrical circuitry which prevents the further control of first solenoid 62 by trigger switch 118. As such, when the top assembly is moved laterally over center, first solenoid 62 is not activated and locking shaft 72 enters receptacle area 80 hereby fixing top assembly 12 in its home position. If additional excursions from the home position are desired, the table 10 must be returned to its translation mode and handle switch 120 and trigger switch 118 actuated.

It will be understood that various changes in the details, materials and arrangements of parts which have been herein described and illustrated in order to explain the nature of the invention may be made by those skilled in the art within the principle and scope of the invention as expressed in the appended claims.

What is claimed is:

1. A table for medical use comprising:

a. an elongated tabletop formed of a radioluscent material and having a patient support surface, said surface having a longitudinal axis and a lateral axis;

b. a base member;

c. carriage means supported by said base member and supporting said tabletop for movement along said longitudinal axis and said lateral axis, said carriage means comprising:

(i) a first carriage having lateral translation channels;

(ii) first roller means attached to said base member and configured to allow said first carriage to be supported by and moved thereon along said lateral axis;

(iii) a second carriage means having longitudinal channels, said second carriage being affixed to the underside of said tabletop;

(iv) second roller means attached to said first carriage and configured to allow said second carriage to be supported by and moved thereon along said longitudinal axis;

d. lateral locking means comprising:

(i) a first locking shaft supported by said base member and in facing relation to said first carriage;

(ii) means for moving said first locking shaft into and out of engagement with a portion of said first carriage, said means for moving comprising:

(a) a first bracket mounted on said base member;

(b) a first rotary solenoid mounted on said first bracket and having a rotational output;

(c) first linkage means connected between said rotational output of said first rotary solenoid and said first locking shaft such that the rotational output of said first rotary solenoid causes said first linkage means to move said first locking shaft to be retracted from engagement with said first carriage; and (d) first spring means coupled between said first bracket and said first locking shaft so as to normally urge said first locking shaft toward said first carriage; and e. longitudinal locking means comprising:

(i) a second locking shaft supported by said first carriage and in facing relation to said second carriage;

(ii) means for moving said second locking shaft into and out of engagement with a portion of said second carriage.

2. The table of claim 1 in which said means for moving said second locking shaft comprises:

a. a second bracket mounted on said first carriage;

b. a second rotary solenoid mounted on second bracket and having a rotational output;

c. second linkage means connected between the rotary output of said second rotary solenoid and said second locking shaft such that the rotational output of said second rotary solenoid causes said second means to cause said second locking shaft to be retracted from engagement with said second carriage; and d. second spring means coupled between said second bracket and said second locking shaft so as to normally urge said second locking shaft toward said second carriage.

3. The table of claim 2 in which said first and said second rotary solenoids comprise rotary electric solenoids.

4. The table of claim 3 in which said first locking shaft moves in a vertical direction and said second locking shaft moves in a horizontal direction.

5. The table of claim 4 in which said portion of said first carriage comprises a receptacle plate attached to the underside of said first carriage and includes a recessed receptacle area which may be engaged by said first locking shaft.

6. The table of claim 5 in which said second locking shaft has on its free end a roller and said portion of said second carriage comprises a notched area that may be engaged by said roller.

* * * * *

UNITED STATES PATENT AND TRADEMARK OFFICE

CERTIFICATE OF CORRECTION

PATENT NO. : 4,944,500

DATED : July 31, 1990

INVENTOR(S) : Arthur T. Nagare and Wolfgang Mueller

It is certified that error appears in the above-identified patent and that said Letters Patent is hereby corrected as shown below:

Col. 1, line 12, after "1988," insert --;--.

Col. 5, line 8, after "selenoid", delete --.--.

Col. 4, line 16, after "coupled", insert --with--.

Signed and Sealed this

Twenty-third Day of June, 1992

*Attest:*

DOUGLAS B. COMER

*Attesting Officer*

*Acting Commissioner of Patents and Trademarks*